US009572738B2

(12) United States Patent
Haworth et al.

(10) Patent No.: US 9,572,738 B2
(45) Date of Patent: Feb. 21, 2017

(54) FACE-DOWN THERAPEUTIC SYSTEM FOR IMPROVED POSTURE AND SPINE ALIGNMENT

(71) Applicant: Kacelia, LLC, Bannockburn, IL (US)

(72) Inventors: Evelyn Haworth, Lake Villa, IL (US); Kelly Haworth, Lake Villa, IL (US); Richard Mazursky, Riverwoods, IL (US); Jeffrey Glass, Riverwoods, IL (US); John Herbst, Streamwood, IL (US)

(73) Assignee: KACELIA, INC., Bannockburn, IL (US)

( * ) Notice: Subject to any disclaimer, the term of this patent is extended or adjusted under 35 U.S.C. 154(b) by 728 days.

(21) Appl. No.: 13/965,513

(22) Filed: Aug. 13, 2013

(65) Prior Publication Data

US 2014/0041122 A1 Feb. 13, 2014

Related U.S. Application Data

(60) Provisional application No. 61/682,580, filed on Aug. 13, 2012.

(51) Int. Cl.
*A61G 7/065* (2006.01)
*A61G 7/07* (2006.01)

(52) U.S. Cl.
CPC ..... *A61G 7/07* (2013.01); *A61G 7/072* (2013.01); *A61G 2200/325* (2013.01); *Y10T 29/49826* (2015.01)

(58) Field of Classification Search
CPC .. A61G 13/12; A61G 13/1205; A61G 13/121; A61G 13/122; A61G 13/1215; A61G 13/123;A61G 13/1255; A61G 7/065; A61G 7/07; A61G 7/072; A61G 7/075; A61G 7/1082; A47C 21/04; A47C 21/042; A47C 21/044; A47C 21/048; A47C 21/003; A47C 21/00
USPC ... 5/632, 630, 621, 622, 624, 731, 733–735, 5/641, 421, 284, 904, 905, 915
See application file for complete search history.

(56) References Cited

U.S. PATENT DOCUMENTS 2,470,398 A * 5/1949 Hayes ..... A61G 7/065 5/624
3,626,526 A * 12/1971 Viel ..... A47C 27/16 5/421
3,843,980 A * 10/1974 Rodriguez ..... A47C 20/021 5/630
5,360,017 A * 11/1994 Austin ..... A47G 9/10 5/640
5,524,640 A * 6/1996 Lisak ..... A47D 13/08 128/869

(Continued)

*Primary Examiner* — Robert G Santos
(74) *Attorney, Agent, or Firm* — McAndrews, Held & Malloy, Ltd.

(57) ABSTRACT

Certain embodiments provide a face-down therapeutic system for improved posture and spine alignment. The system includes a face-piece including at least one cushion operable to receive a face of a user. The face-piece is adapted to be positioned on a flat surface. The system also includes two padded shoulder pieces, where each of the shoulder pieces is operable to receive a shoulder of the user. The shoulder pieces are adapted to be positioned on the flat surface. The system includes a padded pelvic-piece operable to receive a pelvis of the user. The pelvic-piece is adapted to be positioned on the flat surface.

29 Claims, 8 Drawing Sheets

(56) References Cited

U.S. PATENT DOCUMENTS 5,528,784 A * 6/1996 Painter ..... A47G 9/10 5/636
5,642,543 A * 7/1997 Huntley ..... A61F 5/56 5/490
5,953,777 A * 9/1999 Buck ..... A47G 9/0253 5/490
5,953,779 A * 9/1999 Schwartz ..... A47C 27/001 5/692
5,987,676 A * 11/1999 Littleford ..... A47G 9/10 5/636
6,182,314 B1 * 2/2001 Frydman ..... A47C 20/021 128/845
6,345,401 B1 * 2/2002 Frydman ..... A47G 9/10 5/636
6,412,127 B1 * 7/2002 Cuddy ..... A47C 20/026 5/632
6,848,134 B1 * 2/2005 Schenck ..... A61G 1/04 128/870
6,922,860 B2 * 8/2005 Cuddy ..... A47C 20/026 5/632
7,308,725 B2 * 12/2007 Cazzini ..... A61G 7/0507 5/710
7,588,291 B2 * 9/2009 Gold ..... A47D 5/00 297/219.12
7,743,442 B2 * 6/2010 Maloney ..... A47C 21/08 446/72
D618,943 S * 7/2010 Gold ..... D6/596
7,856,688 B2 * 12/2010 Dockendorf ..... A45C 9/00 5/425
8,321,980 B2 * 12/2012 Maloney ..... A47C 21/08 5/424
2004/0155158 A1 * 8/2004 Cuddy ..... A47C 20/026 5/632
2007/0209118 A1 * 9/2007 Cazzini ..... A61G 7/0507 5/710
2007/0245494 A1 * 10/2007 Dockendorf ..... A45C 9/00 5/655
2008/0201854 A1 * 8/2008 Ellis ..... A47D 15/00 5/655
2009/0001801 A1 * 1/2009 Gold ..... A47D 5/00 297/452.47
2009/0211024 A1 * 8/2009 Maloney ..... A47C 21/08 5/424
2010/0223726 A1 * 9/2010 Maloney ..... A47C 21/08 5/500
2014/0041122 A1 * 2/2014 Haworth ..... A61G 7/07 5/632
2014/0090169 A1 * 4/2014 Sclare ..... A47D 13/083 5/421

* cited by examiner

FACE-DOWN THERAPEUTIC SYSTEM FOR IMPROVED POSTURE AND SPINE ALIGNMENT

CROSS-REFERENCE TO RELATED APPLICATIONS/INCORPORATION BY REFERENCE

The present application claims priority under 35 U.S.C. §119(e) to provisional application Ser. No. 61/682,580, filed on Aug. 13, 2012.

The above referenced provisional application is hereby incorporated herein by reference in its entirety.

FEDERALLY SPONSORED RESEARCH OR DEVELOPMENT

[Not Applicable]

MICROFICHE/COPYRIGHT REFERENCE

[Not Applicable]

FIELD OF THE INVENTION

Certain embodiments of the invention relate to a therapeutic system and, more particularly, to a face-down therapeutic system for improving spine alignment and posture.

BACKGROUND OF THE INVENTION

As people age, the soft tissue attachments to the skeletal structure of the human body become less elastic, especially in areas with old injuries where scar tissue has developed. Traumas like car accidents and bad posture can result in forward head posture, reduced cervical curve (whiplash), thoracic hyper-kyphosis (Dowager's hump), lumbosacral hypokyphosis (military back) and hyperlordosis (sway back).

Inversion tables do traction the spine and discs but hanging upside down is uncomfortable to many people and can cause head pressure and ankle discomfort. The mechanical devices that are intended to traction are not as effective, take time out of the schedule to do, and can have mechanical issues.

Current spinal orthotics are usually placed under the supine person putting body weight on the padded, formed, rigid device, intending to improve the spinal curves. The pressure on the muscles and blood vessels impedes the circulation and prevents the muscles from being able to thoroughly relax, minimizing the stretch and reforming effects.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

A face-down therapeutic system, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

DETAILED DESCRIPTION OF THE INVENTION

Figure 1:
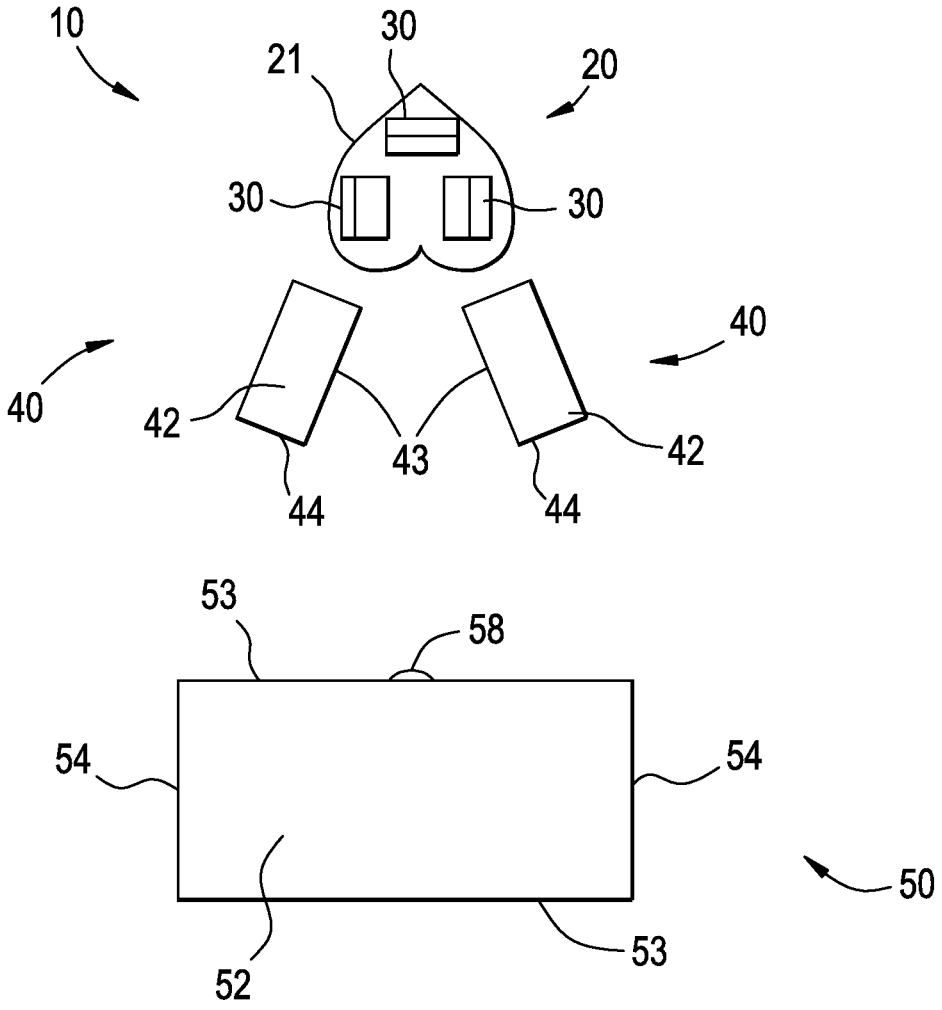
FIG. 1 is a top elevation view of an exemplary face-down therapeutic system, in accordance with a representative embodiment of the present invention.

Aspects of the present invention are related to a face-down therapeutic system that is structurally therapeutic. More specifically, the face-down therapeutic system is a spinal orthotic adapted to influence the spine, shoulders and hips. A representative embodiment of the present invention aids a user of the face-down therapeutic system with improving spine alignment and posture.

Various embodiments provide a face-down therapeutic system 10. In a representative embodiment, the system 10 comprises a face-piece 20 comprising at least one cushion 30 operable to receive a face of a user. The face-piece 20 is adapted to be positioned on a flat surface. The system 10 comprises two padded shoulder pieces 40. Each of the shoulder pieces 40 is operable to receive a shoulder of the user. The shoulder pieces 40 are adapted to be positioned on the flat surface. The system 10 comprises a padded pelvic-piece 50 operable to receive a pelvis of the user. The pelvic-piece 50 is adapted to be positioned on the flat surface.

Certain embodiments provide a method 800 for arranging a face-down therapeutic system 10. The method 800 comprises positioning 820 a face-piece 20 of a face-down therapeutic system 10 on a flat surface. The method 800 comprises positioning 830 shoulder pieces 40 of the face-down therapeutic system 10 on the flat surface. The method 800 comprises positioning 840 a pelvic-piece 50 of the face-down therapeutic system 10 on the flat surface. The method 800 comprises laying 860 face-down on the face-down therapeutic system 10 such that a face of a user is positioned in the face-piece 20, shoulders of the user are positioned on the shoulder pieces 40, and a pelvis of the user is positioned on the pelvic-piece 50.

As utilized herein, the terms "exemplary" or "example" means serving as a non-limiting example, instance, or illustration. As utilized herein, the term "e.g." introduces a list of one or more non-limiting examples, instances, or illustrations.

FIG. 1 is a top elevation view of an exemplary face-down therapeutic system 10, in accordance with a representative embodiment of the present invention. Referring to FIG. 1, a face-down therapeutic system 10 comprises a face-piece 20, shoulder pieces 40, and a pelvic-piece 50. The face-piece 20 may include one or more face-piece cushions 30 attached to a base 21 and configured to receive a face of a user. For example, the face-piece cushion(s) 30 may be adapted to receive a forehead and cheeks or points on a jaw of a user. In various embodiments, the position(s) of face-piece cushion(s) 30 can correspond with pressure points on a face of a user for improving jaw alignment and elasticity, for example. The cushion(s) 30 may be foam, a vinyl inflatable vessel, water or oil filled bladder, or any suitable cushion mechanism. The cushion(s) 30 can be molded using various molding techniques such as vacuum forming, blow molding, injection molding, or any suitable molding technique. The cushion(s) 30 can include a cover. In various embodiments, the cover may be removeable and washable, for example. The cushion(s) 30 can be integrated with and/or attached to the base 21. The base 21 of the face-piece 20 may be placed on a bed, a lounger, a masseuse table, a mat (such as the index mat 60 described below with reference to FIG. 2), a floor, or any suitable location with room for a user of the face-down therapeutic system 10 to lie down in a prone position with the face of the user placed in the face-piece 20. The base 21 can be plastic, wood, metal, or any suitable material. Although FIG. 1 illustrates the base 21 in a heart shape, the base 21 can be square-shaped, circular, U-shaped, or any suitable shape, for example.

In certain embodiments, the face-piece 20 may include speakers such that a user can listen to music, the radio, audio books, and the like while using the face-down therapeutic system 10. The speakers may be incorporated in the base 21 and/or cushion(s) 30. The face-piece 20 can comprise a port for connecting to an audio source and/or include an audio source in the face-piece 20, for example. In various embodiments, the face-piece 20 comprises one or more lighting devices for illuminating an area below and/or between the cushion(s) 30 so that a user may view a handheld electronic device, a book, a magazine, or any suitable item. The lighting device(s) can be integrated or attached to the base 21 or cushion(s) 30 of the face-piece 20 and may be connected to a switch for activating and deactivating the lighting device(s). The switch can be integrated or attached to the base 21 or cushion(s) 30, for example. In certain embodiments, the face-piece 20 can include an electrical plug for connecting to an outlet for providing power to attached and/or integrated electronic devices. Additionally and/or alternatively, electronic devices integrated and/or attached to the face-piece 20 can be powered by battery, solar panel, or any suitable power supply, for example. In certain embodiments, the face-piece 20 may be adapted to provide aromatherapy to a user of the face-down therapeutic system 10. For example, perfumed powders, potpourris, scented oils, or the like may be placed in a container or sachet integrated or attached to the base 21 or cushion(s) 30 of the face-piece 20.

The shoulder pieces 40 may be generally rectangular box-shaped padded pieces for receiving and stretching shoulders of a user back while the user lies face down on the therapeutic system 10. The shoulder pieces 40 can be foam, a vinyl inflatable vessel, water or oil filled bladder, or any suitable padding mechanism. The shoulder pieces 40 may have rounded edges for additional comfort. In various embodiments, the shoulder pieces 40 can include at least two layers as discussed below with regard to FIGS. 5A-5C. In certain embodiments, each of the shoulder pieces 40 can include a cover. In various embodiments, the cover may be removeable and washable, for example. The shoulder pieces 40 may be placed on a bed, a lounger, a masseuse table, a mat (such as the index mat 60 described below with reference to FIG. 2), or any suitable location with room for a user of the face-down therapeutic system 10 to lie down in a prone position with the shoulders of the user placed on the shoulder pieces 40.

The pelvic-piece 50 may be a generally rectangular or trapezoidal box-shaped padded piece for receiving a pelvis of a user to stretch the lower lumber, sacroiliac joints, and hip joints, and traction the lumbar discs while the user lies face down on the therapeutic system 10. The pelvic-pieces 50 can be foam, a vinyl inflatable vessel, water or oil filled bladder, or any suitable padding mechanism. The pelvic-piece 50 may have rounded edges for additional comfort. In various embodiments, the pelvic-piece 50 can include at least two layers as discussed below with regard to FIGS. 6A-6C and 7. In certain embodiments, the pelvic-piece 50 can include a cover. In various embodiments, the cover may be removeable and washable, for example. In certain embodiments, the pelvic-piece 50 can include an instructional indicator 58 for providing instructions related to the use of the face-down therapeutic system 10. Additionally and/or alternatively, the instructional indicator 58 can be placed on one or more of any of the therapeutic system pieces 20, 40, 50, for example. The instructional indicator 58 can be a sticker, patch, or any suitable instructional indicator. The pelvic-piece 50 may be placed on a bed, a lounger, a masseuse table, a mat (such as the index mat 60 described below with reference to FIG. 2), or any suitable location with room for a user of the face-down therapeutic system 10 to lie down in a prone position with the pelvis of the user placed on the pelvic-piece 50.

Various embodiments provide that one or more of the face-piece 20, shoulder pieces 40, and pelvic-piece 50 can include one or more vibrating mechanisms to provide a massage-like experience to a user of the face-down therapeutic system 10. The vibrating mechanism(s) can be powered by an electrical plug for connecting to an outlet, a battery, a solar panel, or any suitable power supply, for example. The vibrating mechanism(s) can be connected to a switch for activating and deactivating the vibrating mechanism(s). The switch can be integrated or attached to the face-piece 20, shoulder pieces 40, and/or pelvic-piece 50, for example. Certain embodiment provide that one or more of the face-piece 20, shoulder pieces 40, and pelvic-piece 50 may include one or more temperature control elements to provide a warmer or cooler surface of the therapeutic system pieces 20, 40, 50. For example, the temperature control elements can be a heating pad, cooling pad, gel pack, or any suitable temperature control element.

In certain embodiments, the face-down therapeutic system 10 can comprise an ankle support such as a foam roll, a semi-circular pad, or any suitable support mechanism for elevating ankles of a user. For example, an ankle support mechanism can provide a comfortable foot position for a face-down therapeutic system user so leg weight is not fully placed on the toes of the user. In various embodiments, the face-down therapeutic system 10 may include extension pieces that can each be detachably coupled to two of the therapeutic system pieces 20, 40, 50 such that each of the therapeutic system pieces 20, 40, 50 can be secured in relation to one or more of the other therapeutic system pieces 20, 40, 50. As an example, an extension piece can include loop fasteners at each end for detachably coupling to corresponding hook fasteners on the bottom of the face-piece base 21 and the bottom of a shoulder-piece 40 such that the extension piece secures the shoulder-piece 40 in a position relative to the face-piece 20.

In operation, a user lays face down, and their face is supported by the face-piece 20, their shoulders are supported by the shoulder-piece 40, and the pelvic-piece 50 provides support for the pelvis. The spinal orthotic device 10 uses gravity to exert a downward pressure upon the body causing the cervical spine to relax into extension and shifts the head back, which reduces forward head posture and encourages the normal cervical curve to reform after whiplash injuries. Additionally, the shoulder pads stretch the shoulders back while gravity exerts downward pressure on the thoracic spine reducing hyperkyphosis. The device also encourages the pectoral muscles to stretch open. The pelvic-piece causes the lower lumber, sacroiliac joints, and hip joints to stretch, and traction the lumbar discs which alleviates degenerative and herniated discs.

Figure 2:
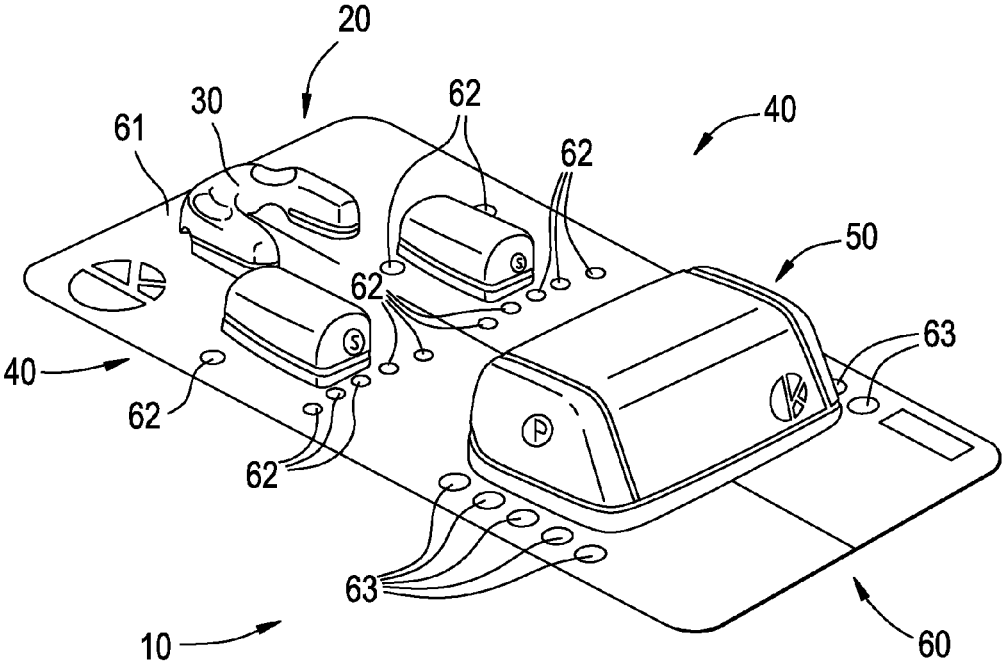
FIG. 2 is a perspective view of an exemplary face-down therapeutic system with an index mat, in accordance with a representative embodiment of the present invention.

FIG. 2 is a perspective view of an exemplary face-down therapeutic system 10 with an index mat 60, in accordance with a representative embodiment of the present invention. Referring to FIG. 2, a face-down therapeutic system 10 comprises a face-piece 20, shoulder pieces 40, a pelvic-piece 50, and an index mat 60. The face-piece 20 may include one or more face-piece cushions 30 configured to receive a face of a user. As illustrated in FIG. 2, the face-piece 20 can be a U-shaped cushion 30. In certain embodiments, the face-piece 20 and/or cushion 30 may include notches or cut-outs to provide access to air for easier breathing by a user of the face-down therapeutic system 10. The shoulder pieces 40 may be generally rectangular box-shaped padded pieces for receiving and stretching shoulders of a user back while the user lies face down on the therapeutic system 10. The pelvic-piece 50 may be generally rectangular or trapezoidal box-shaped padded piece for receiving a pelvis of a user to stretch the lower lumber, sacroiliac joints, and hip joints, and traction the lumbar discs while the user lies face down on the therapeutic system 10.

The face-piece 20, shoulder pieces 40, and pelvic-piece 50 may be placed on an index mat 60 comprising face-piece alignment indicators 61, shoulder-piece alignment indicators 62, and pelvic-piece alignment indicators 63. For example, the face-piece 20, shoulder pieces 40, and pelvic-piece 50 can include one or more alignment marks to align with the alignment indicators 61-63 when positioning the pieces 20, 40, 50 on the index mat 60. The index mat 60 can be cloth covered foam, a sheet of polyvinyl chloride (PVC), or any suitable material. The alignment indicators 61-63 can be molded, printed, attached, or the like to the index mat 60, for example. The face-piece alignment indicators 61 can provide one or more face-piece 20 alignment options so that a user of the face-down therapeutic system 10 can repeatedly place the face-piece 20 at a proper position and orientation prior to each use. The shoulder-piece alignment indicators 62 may provide one or more alignment options for each of the shoulder pieces 40 so that a user of the face-down therapeutic system 10 can repeatedly place each of the shoulder pieces 40 at a proper position and orientation prior to each use. The pelvic-piece alignment indicators 63 can provide one or more pelvic-piece 50 alignment options so that a user of the face-down therapeutic system 10 can repeatedly place the pelvic-piece 50 at a proper position and orientation prior to each use. In various embodiments, a user may be fitted by a chiropractor or other healthcare professional, where the fitting procedure results in the healthcare professional identifying the appropriate face-piece alignment indicators 61, shoulder-piece alignment indicators 62, and pelvic-piece alignment indicators 63 for a particular user of the face-down therapeutic system 10.

Various embodiments provide that the bottoms, sides, and/or ends of the face-piece 20, shoulder pieces 40, and pelvic-piece 50 can comprise one or more attachment mechanisms for detachably coupling to corresponding attachment mechanisms of the index mat 60. The attachment mechanisms of the index mat 60 may correspond to various positions identified by the face-piece alignment indicators 61, shoulder-piece alignment indicators 62, and pelvic-piece alignment indicators 63, for example. The attachment mechanisms of the index mat 60 and therapeutic system pieces 20, 40, 50 can include hook and loop fasteners, snaps, buttons, teeth and grooves, pegs and holes, and/or any suitable attachment mechanisms. In various embodiment, the attachment mechanisms of the therapeutic system pieces 20, 40, 50 can include indicators that extend outward from the therapeutic system pieces 20, 40, 50 to align with indicators 61, 62, 63 of the index mat 60 such that a user can readily identify the indicated position of the therapeutic system pieces 20, 40, 50.

Certain embodiments provide that the index mat 60 can include one or more handles and/or one or more securing mechanisms such that the index mat can be folded, closed, and/or carried with or without the therapeutic system pieces 20, 40, 50 attached to the index mat 60. For example, the securing mechanisms can include zipper(s), hook and loop fasteners, snaps, buttons, and/or any suitable securing mechanisms. In certain embodiments, the face-down therapeutic system 10 can comprise an ankle support such as a foam roll, a semi-circular pad, or any suitable support mechanism for elevating ankles of a user. For example, an ankle support mechanism can provide a comfortable foot position for a face-down therapeutic system user so leg weight is not fully placed on the toes of the user. In various embodiments, the therapeutic system pieces 20, 40, 50, 60 can be used for stretching and strengthening exercises, for example.

The face-down therapeutic system 10 illustrated in FIG. 2 shares various characteristics with the face-down therapeutic system 10 illustrated in FIG. 1 as described above.

Figure 3A:
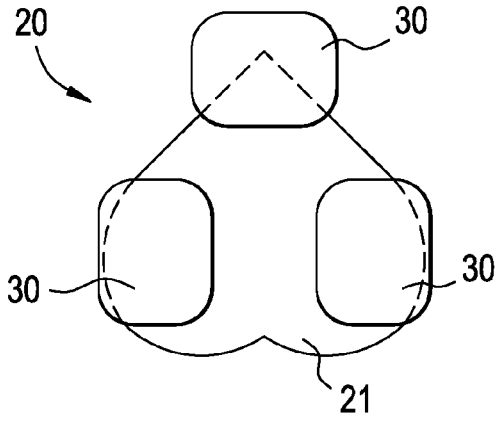
FIG. 3A is a top elevation view of an exemplary face-down therapeutic system face-piece, in accordance with a representative embodiment of the present invention.
Figure 3B:
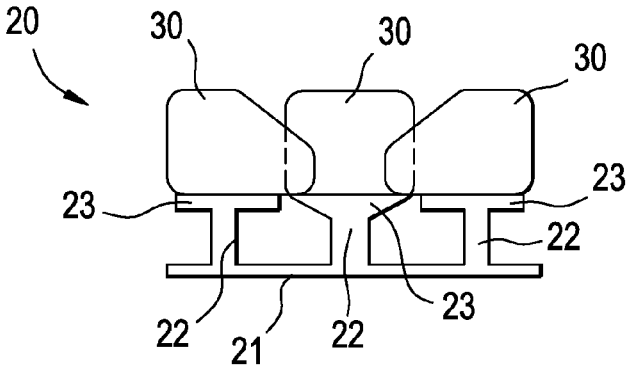
FIG. 3B is a rear elevation view of an exemplary face-down therapeutic system face-piece, in accordance with a representative embodiment of the present invention.
Figure 3C:
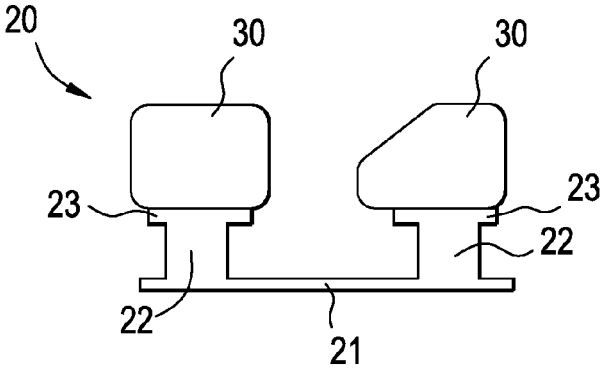
FIG. 3C is a side elevation view of an exemplary face-down therapeutic system face-piece, in accordance with a representative embodiment of the present invention.

FIG. 3A is a top elevation view of an exemplary face-down therapeutic system face-piece 20, in accordance with a representative embodiment of the present invention. FIG. 3B is a rear elevation view of an exemplary face-down therapeutic system face-piece 20, in accordance with a representative embodiment of the present invention. FIG. 3C is a side elevation view of an exemplary face-down therapeutic system face-piece 20, in accordance with a representative embodiment of the present invention. Referring to FIGS. 3A-3C, the face-down therapeutic system face-piece 20 comprises one or more face-piece cushions 30 each attached to a top surface 23 of a pedestal 22 extending upward from a base 21. The face-piece cushions 30 may be adapted to receive a face of a user, such as a forehead and cheeks or points on a jaw of a user, for example. In various embodiments, each cushion 30 can be coupled to the top surface 23 of a pedestal 22 integrated with and/or attached to the base 21 using an adhesive, snaps, hook and loop fasteners, or any suitable attachment mechanism.

The base 21, pedestals 22, and top surfaces 23 of the face-piece 20 may be plastic, wood, metal, or any suitable material. The base 21, pedestals 22, and top surfaces 23 can be an integrated piece or may be separate components attached by screws, nails, adhesive, or any suitable attachment mechanism. Although FIG. 1 illustrates the base 21 in a heart shape, the base 21 can be square-shaped, circular, u-shaped, or any suitable shape, for example. In certain embodiments, the height of the pedestals 22 may be adjustable. For example, the pedestals can be telescoping and include a locking mechanism to secure the pedestals 22 at a selected height.

The face-down therapeutic system face-piece 20 illustrated in FIGS. 3A-3C shares various characteristics with the face-down therapeutic system face-piece 20 illustrated in FIG. 1 as described above.

Figure 4A:
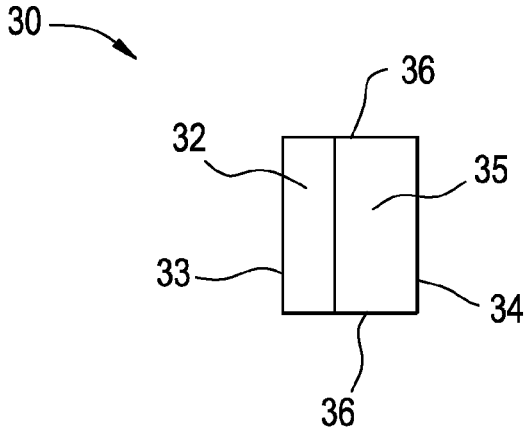
FIG. 4A is a top elevation view of an exemplary cushion of a face-down therapeutic system face-piece, in accordance with a representative embodiment of the present invention.
Figure 4B:
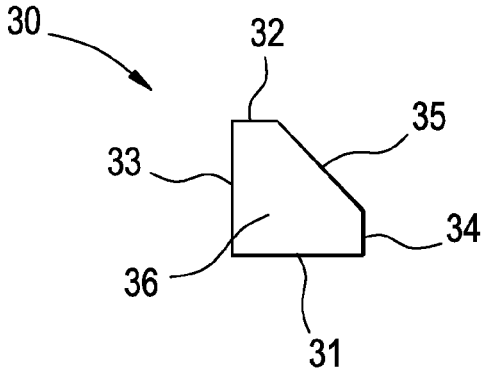
FIG. 4B is a side elevation view of an exemplary cushion of a face-down therapeutic system face-piece, in accordance with a representative embodiment of the present invention.
Figure 4C:
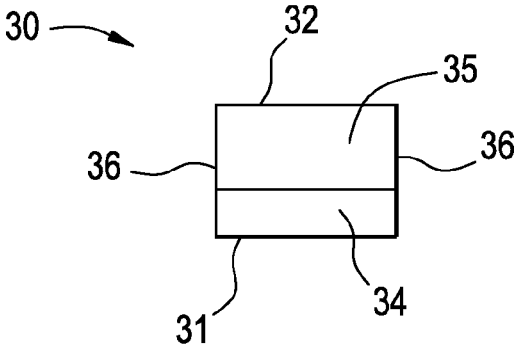
FIG. 4C is a front elevation view of an exemplary cushion of a face-down therapeutic system face-piece, in accordance with a representative embodiment of the present invention.

FIG. 4A is a top elevation view of an exemplary cushion 30 of a face-down therapeutic system face-piece 20, in accordance with a representative embodiment of the present invention. FIG. 4B is a side elevation view of an exemplary cushion 30 of a face-down therapeutic system face-piece 20, in accordance with a representative embodiment of the present invention. FIG. 4C is a front elevation view of an exemplary cushion 30 of a face-down therapeutic system face-piece 20, in accordance with a representative embodiment of the present invention. Referring to FIGS. 4A-4C, the face-piece cushion(s) 30 may be generally in a shape of a heptahedron, pentahedron, or any suitable shape that comprises a tapered inner side 35 that generally extends from a top 32 outer back side 33 to a front 34 bottom 31 portion of the face-piece cushion 30. For example, a heptahedron-shaped face-piece cushion 30 can comprise a bottom 31, top 32, outer back side 33, front side 34, tapered inner side 35, and ends 36. In certain embodiments, the edges of the face-piece cushion(s) 30 may be rounded. The tapered inner side 35 can be flat or curved and may be adapted to receive a forehead and cheeks or points on a jaw of a user. In various embodiments, the position(s) of face-piece cushion(s) 30 can correspond with pressure points on a face of a user for improving jaw alignment and elasticity, for example. The cushion(s) 30 may be foam, a vinyl inflatable vessel, water or oil filled bladder, or any suitable cushion mechanism. The cushion(s) 30 can include a cover. In various embodiments, the cover may be removeable and washable, for example.

The face-down therapeutic system face-piece cushions 30 illustrated in FIGS. 4A-4C shares various characteristics with the face-down therapeutic system face-piece cushions 30 illustrated in FIGS. 1 and 3A-3C as described above.

Figure 5A:
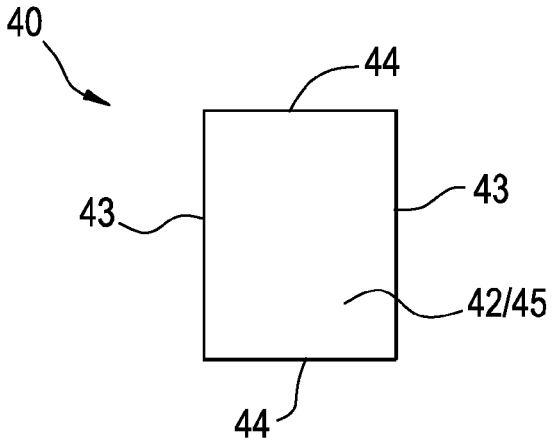
FIG. 5A is a top elevation view of an exemplary face-down therapeutic system shoulder-piece, in accordance with a representative embodiment of the present invention.
Figure 5B:
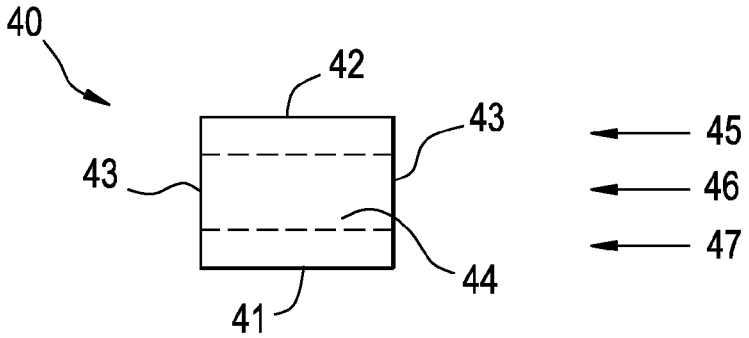
FIG. 5B is an end elevation view of an exemplary face-down therapeutic system shoulder-piece, in accordance with a representative embodiment of the present invention.
Figure 5C:
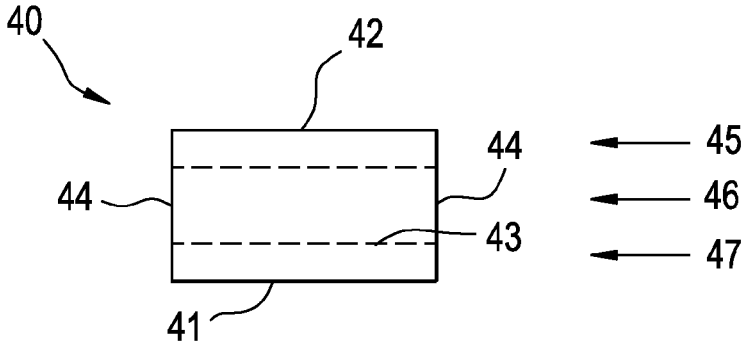
FIG. 5C is a side elevation view of an exemplary face-down therapeutic system shoulder-piece, in accordance with a representative embodiment of the present invention.

FIG. 5A is a top elevation view of an exemplary face-down therapeutic system shoulder-piece 40, in accordance with a representative embodiment of the present invention. FIG. 5B is an end elevation view of an exemplary face-down therapeutic system shoulder-piece 40, in accordance with a representative embodiment of the present invention. FIG. 5C is a side elevation view of an exemplary face-down therapeutic system shoulder-piece 40, in accordance with a representative embodiment of the present invention. Referring to FIGS. 5A-5C, the shoulder-piece 40 may be a generally rectangular box-shaped padded piece for receiving a shoulder of a user while the user lies face down on the therapeutic system 10. For example, a rectangular box-shaped shoulder-piece 40 can comprise a bottom 41, top 42, sides 43, and ends 44. The shoulder-piece 40 can be foam, a vinyl inflatable vessel, water or oil filled bladder, or any suitable padding mechanism. The shoulder-piece 40 may have rounded edges for additional comfort. In certain embodiments, each shoulder-piece 40 can include a cover. In various embodiments, the cover may be removeable and washable, for example.

Certain embodiments provide that the shoulder-piece 40 may comprise one or more layers 45-47. For example, the layers 45-47 can include a top layer 45 for providing a soft, cushioned surface for receiving a shoulder of a user of the face-down therapeutic system 10. The top layer 45 may be a cushioned polyester fabric (e.g., Dacron), memory foam, or any suitable soft, cushioned material. The layers 45-47 may include a body layer 46 that can be firmer than the top layer 45 to maintain the shape of the shoulder-piece 40. The body layer 46 may be a polyurethane foam block, molded plastic, wood or metal framing, or any suitable material. The layers 45-47 can include an optional base layer 47. In various embodiments, the base layer 47 may include sub-layers that can be added or removed to adjust a height of the shoulder-piece 40. For example, the shoulder-piece 40 is the shortest with the base layer 47 removed and can be taller with each sub-layer added as a base layer 47. The base layer 47 can be closed cell polyurethane foam shims or any suitable material, for example. Additionally and/or alternatively, the height of the shoulder-piece 40 can be adjusted by adding a mechanical and/or electric device such as a crank, among other things, for raising or lowering the shoulder-piece 40.

The face-down therapeutic system shoulder-piece 40 illustrated in FIGS. 5A-5C shares various characteristics with the face-down therapeutic system shoulder pieces 40 illustrated in FIGS. 1-2 as described above.

Figure 6A:
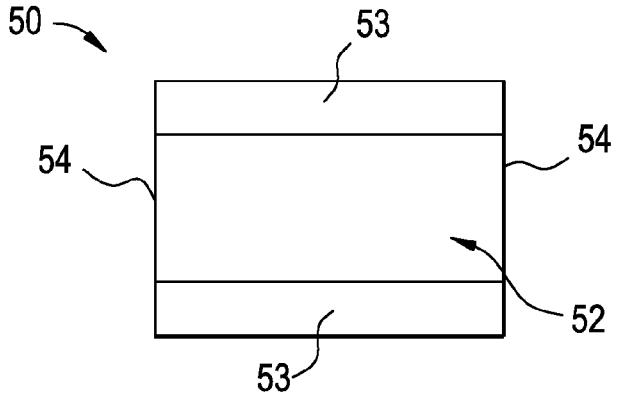
FIG. 6A is a top elevation view of an exemplary face-down therapeutic system pelvic-piece, in accordance with a representative embodiment of the present invention.
Figure 6B:
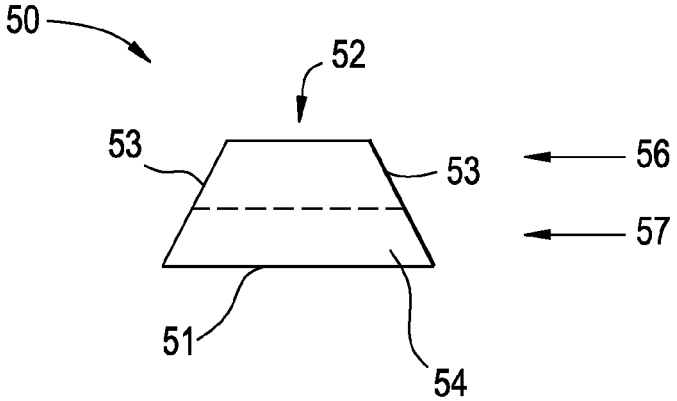
FIG. 6B is an end elevation view of an exemplary face-down therapeutic system pelvic-piece, in accordance with a representative embodiment of the present invention.
Figure 6C:
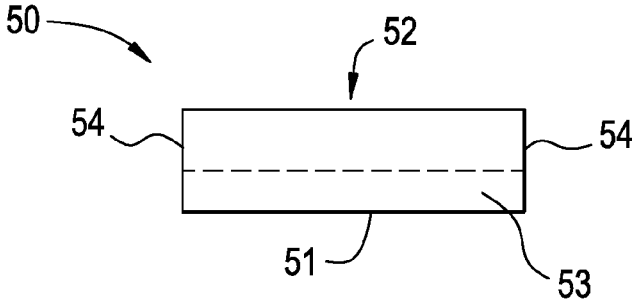
FIG. 6C is a side elevation view of an exemplary face-down therapeutic system pelvic-piece, in accordance with a representative embodiment of the present invention.

FIG. 6A is a top elevation view of an exemplary face-down therapeutic system pelvic-piece 50, in accordance with a representative embodiment of the present invention. FIG. 6B is an end elevation view of an exemplary face-down therapeutic system pelvic-piece 50, in accordance with a representative embodiment of the present invention. FIG. 6C is a side elevation view of an exemplary face-down therapeutic system pelvic-piece 50, in accordance with a representative embodiment of the present invention. Referring to FIGS. 6A-6*c*, the pelvic-piece 50 may be a generally rectangular or trapezoidal box-shaped padded piece for receiving a pelvis of a user while the user lies face down on the therapeutic system 10. For example, a rectangular or trapezoidal box-shaped pelvic-piece 50 can comprise a bottom 51, top 52, sides 53, and ends 54. In the trapezoidal embodiment as illustrated in FIGS. 6A-6C, the sides 53 may be tapered between the top 52 and bottom 51. The pelvic-piece 50 can be foam, a vinyl inflatable vessel, water or oil filled bladder, or any suitable padding mechanism. The pelvic-piece 50 may have rounded edges for additional comfort. In certain embodiments, the pelvic-piece 50 can include a cover. In various embodiments, the cover may be removeable and washable, for example.

Certain embodiments provide that the pelvic-piece 50 may comprise one or more layers 55-57. For example, the layers 55-57 can include a body layer 56 for maintaining the shape of the pelvic-piece 50. The body layer 56 may be a polyurethane foam block, molded plastic, wood or metal framing, or any suitable material. The layers 55-57 can include an optional base layer 57. In various embodiments, the base layer 57 may include sub-layers that can be added or removed to adjust a height of the pelvic-piece 50. For example, the pelvic-piece 50 is the shortest with the base layer 57 removed and can be taller with each sub-layer added as a base layer 57. The base layer 57 can be closed cell polyurethane foam shims or any suitable material, for example. Additionally and/or alternatively, the height of the pelvic-piece 50 can be adjusted by adding a mechanical and/or electric device such as a crank, among other things, for raising or lowering the pelvic-piece 50.

The face-down therapeutic system pelvic-piece 50 illustrated in FIGS. 6A-6C shares various characteristics with the face-down therapeutic system pelvic-piece 50 illustrated in FIGS. 1-2 as described above.

Figure 7:
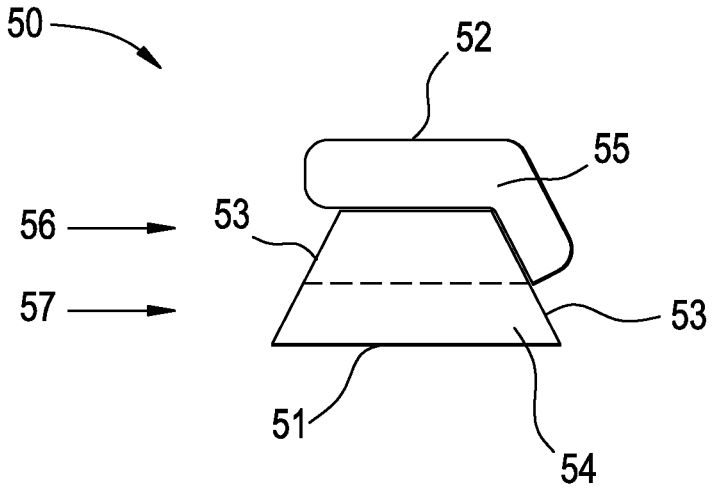
FIG. 7 is an end elevation view of an exemplary face-down therapeutic system pelvic-piece with top cushion layer, in accordance with a representative embodiment of the present invention.

FIG. 7 is an end elevation view of an exemplary face-down therapeutic system pelvic-piece 50 with top cushion layer 55, in accordance with a representative embodiment of the present invention. Referring to FIG. 7, the pelvic-piece 50 may be a generally rectangular or trapezoidal box-shaped padded piece for receiving a pelvis of a user while the user lies face down on the therapeutic system 10. For example, a rectangular or trapezoidal box-shaped pelvic-piece 50 can comprise a bottom 51, top 52, sides 53, and ends 54. In the trapezoidal embodiment as illustrated in FIG. 7, the sides 53 may be tapered between the top 52 and bottom 51. The pelvic-piece 50 can include a top layer 55 for providing a soft, cushioned surface for receiving a pelvis of a user of the face-down therapeutic system 10. The top layer 55 may be a cushioned polyester fabric (e.g., Dacron), memory foam, or any suitable soft, cushioned material. The pelvic-piece 50 may include a body layer 56 that can be firmer than the top layer 55 to maintain the shape of the pelvic-piece 50. The pelvic-piece 50 can include an optional base layer 57. In various embodiments, the base layer 57 may include sub-layers that can be added or removed to adjust a height of the pelvic-piece 50.

The face-down therapeutic system pelvic-piece 50 with top cushion layer 55 illustrated in FIG. 7 shares various characteristics with the face-down therapeutic system pelvic-piece 50 illustrated in FIGS. 1-2 and 6A-6C as described above.

Figure 8:
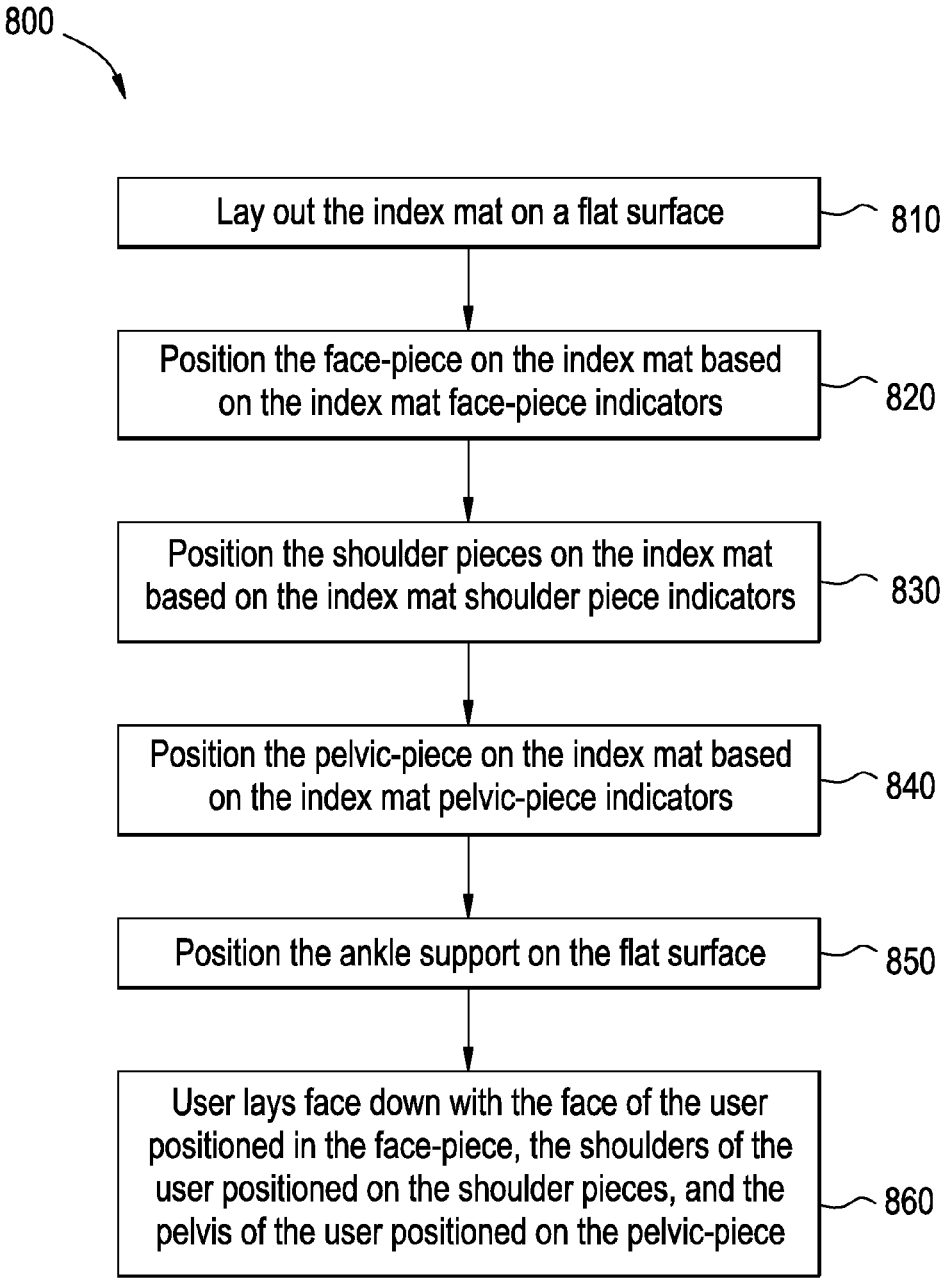
FIG. 8 is a flowchart illustrating an exemplary method for arranging the face-down therapeutic system of FIGS. 1-2, in accordance with a representative embodiment of the present invention.

FIG. 8 is a flowchart illustrating an exemplary method for arranging the face-down therapeutic system 10 of FIGS. 1-2, in accordance with a representative embodiment of the present invention. The actions of the method of FIG. 8 may be performed using elements of the face-down therapeutic system 10 of FIGS. 1-7 including, for example, the face-piece 20, face-piece cushions 30, shoulder pieces 40, pelvic-piece 50, and/or index mat 60. Certain embodiments of the present invention may omit one or more of the actions, and/or perform the actions in a different order than the order listed, and/or combine certain of the actions discussed below. For example, some actions may not be performed in certain embodiments of the present invention. As a further example, certain actions may be performed in a different temporal order, including simultaneously, than listed below.

The method of FIG. 8 begins at block 810, where an index mat 60 is laid out on a flat surface. The index mat 60 can be cloth covered foam, a sheet of polyvinyl chloride (PVC), or any suitable material. The index mat 60 may include alignment indicators 61-63 adapted to provide alignment options for one or more of the face-piece 20, the shoulder pieces 40, and the pelvic-piece 50, for example. In various embodiments, the index mat 60 can include attachment mechanisms for detachably coupling with the bottoms, sides, and/or ends of the face-piece 20, shoulder pieces 40, and pelvic-piece 50. The attachment mechanisms of the index mat 60 may correspond to various positions identified by the face-piece alignment indicators 61, shoulder-piece alignment indicators 62, and pelvic-piece alignment indicators 63, for example. The attachment mechanisms of the index mat 60 and therapeutic system pieces 20, 40, 50 can include hook and loop fasteners, snaps, buttons, teeth and grooves, pegs and holes, and/or any suitable attachment mechanisms. In certain embodiments, block 810 may be skipped and a user may carry out the actions of blocks 820-860 without the index mat 60 comprising the alignment indicators 61-63, for example.

Next, at block 820, the face-piece 20 may be positioned on the index mat 60 or on a flat surface. In embodiments employing the index mat 60, the face-piece 20 can be positioned on the index mat 60 based on face-piece alignment indicators 61 of the index mat 60. In various embodiments, the face-piece 20 can include attachment mechanisms for securing the face-piece 20 to a corresponding attachment mechanism associated with a selected face-piece alignment indicator 61 of the index mat 60. At block 830, the shoulder pieces 40 may be positioned on the index mat 60 or on the flat surface. In embodiments employing the index mat 60, each of the shoulder pieces 40 can be positioned on the index mat 60 based on shoulder-piece alignment indicators 62 of the index mat 60. In certain embodiments, the shoulder pieces 40 can include attachment mechanisms for securing each of the shoulder pieces 40 to a corresponding attachment mechanism associated with a selected shoulder-piece alignment indicator 62 of the index mat 60. Additionally and/or alternatively, the shoulder pieces 40 can be positioned on the index mat 60 and/or the flat surface based on the positions of previously placed therapeutic system pieces 20, 40, 50. For example, the shoulder pieces 40 can be positioned in relation to each other and to the face-piece 20 positioned at block 820.

At block 840, the pelvic-piece 50 may be positioned on the index mat 60 or on the flat surface. In embodiments employing the index mat 60, the pelvic-piece 50 can be positioned on the index mat 60 based on pelvic-piece alignment indicators 63 of the index mat 60. In various embodiments, the pelvic-piece 50 can include attachment mechanisms for securing the pelvic-piece 50 to a corresponding attachment mechanism associated with a selected pelvic-piece alignment indicator 63 of the index mat 60. Additionally and/or alternatively, the pelvic-piece 50 can be positioned on the index mat 60 and/or the flat surface based on the positions of previously placed therapeutic system pieces 20, 40. For example, the pelvic-piece 50 can be positioned in relation to each of the shoulder pieces 40 positioned at block 830 and/or the face-piece 20 positioned at block 820. At step 850, an ankle support may be positioned on the flat surface or on the index mat 60. After the face-down therapeutic system pieces 20, 40, 50 and the ankle support have been positioned on the index mat 60 or a flat surface at blocks 820-850, a user, at block 860, can lie face down on the therapeutic system 10 with the face of the user positioned in the face-piece 20, the shoulders of the user positioned on the shoulder pieces 40, and the pelvis of the user positioned on the pelvic-piece 50.

Various embodiments may include a lounger or massage table, with adjustable legs. The lounger or massage table may be portable and/or foldable, for example. The face-piece 20 can be aligned with a hole in the lounger or massage table such that a user has a view below the table. In certain embodiments, a shelf can extend from the front legs of the table or lounger. The shelf may be positioned under the face-piece 20 and approximately 18 inches below the table top such that the shelf can be used as a table top for a user that desires to view items such as books, magazines, electronic devices, or the like while positioned on the face-down therapeutic system 10 arranged on the lounger or massage table, for example.

Certain embodiments of the face-down therapeutic system 10 may include a travel model where various components such as the shoulder pieces 40 and pelvic-piece 50 are vinyl inflatable pieces, for example. In various embodiments, the shoulder pieces 40 and pelvic-piece 50 of the body orthotic 10 can be employed as a bed lounger by placing the pelvic-piece 50 against a headboard of a bed with the shoulder pieces 40 placed on each side and in front of the pelvic-piece 50, for arm rests.

Aspects of the present invention may be seen in a face-down therapeutic system 10. In a representative embodiment, the system 10 comprises a face-piece 20 comprising at least one cushion 30 operable to receive a face of a user. The face-piece 20 is adapted to be positioned on a flat surface. The system 10 comprises two padded shoulder pieces 40. Each of the shoulder pieces 40 is operable to receive a shoulder of the user. The shoulder pieces 40 are adapted to be positioned on the flat surface. The system 10 comprises a padded pelvic-piece 50 operable to receive a pelvis of the user. The pelvic-piece 50 is adapted to be positioned on the flat surface.

In various embodiments, each of the two padded shoulder pieces 40 is generally rectangular box-shaped pieces. In certain embodiments, each of the two padded shoulder pieces 40 comprises a top cushioned layer 45 operable to receive the shoulder of the user and a body layer 46 that is firmer than the top cushioned layer 45. In a representative embodiment, each of the two padded shoulder pieces 40 comprises a base layer 47 comprising multiple sub-layers that are added or removed to adjust a height of each of the two padded shoulder pieces 40.

In various embodiments, the pelvic-piece 50 is generally a rectangular or trapezoidal box-shaped piece. In certain embodiments, the pelvic-piece 50 comprises a top cushioned layer 55 operable to receive the pelvis of the user and a body layer 56 that is firmer than the top cushioned layer 55. In a representative embodiment, the pelvic-piece 50 comprises a base layer 57 comprising multiple sub-layers that are added or removed to adjust a height of the pelvic-piece 50. In various embodiments, the height of the shoulder pieces 40 and the pelvic-piece 50 is adjustable.

In certain embodiments, the face-piece 20 is a U-shaped cushion 30 operable to receive the face of the user. In a representative embodiment, the face-piece 20 comprises at least one cut-out to provide access to air. In various embodiments, the face-piece 20 comprises a base 21 adapted to be positioned on the flat surface. The face-piece 20 comprises a plurality of pedestals 22 attached to the base 21. Each of the plurality of pedestals 22 comprises a pedestal top 23. The face-piece 20 comprises the at least one cushion 30. The at least one cushion 30 comprises a plurality of cushions 30. Each of the plurality of cushions 30 is attached to one of the plurality of pedestal tops 23. In various embodiments, the height of each of the plurality of pedestals 22 is adjustable. In certain embodiments, each of the plurality of cushions 30 comprises a bottom 31, a top 32, an outer back side 33, a front 34, ends 36, and a tapered inner side 35. The bottom 31 is operable to attach to one of the plurality of pedestal tops 23. The tapered inner side 35 generally extends from the top 32, outer back side 33 to the bottom 31, front 34. The tapered inner side 35 is operable to receive the face of the user.

In a representative embodiment, one or more of the at least one cushion 30, the shoulder pieces 40, and the pelvic-piece 50 comprises a removeable cover. In various embodiments, one or more of the at least one cushion 30, the shoulder pieces 40, and the pelvic-piece 50 is at least one of foam, a vinyl inflatable vessel, and a water or oil filled bladder. In certain embodiments, the face-piece 20 comprises at least one speaker, and an audio port connected to the at least one speaker. The audio port is operable to receive an audio input and provide the audio input to the at least one speaker. In a representative embodiment, the face-piece 20 comprises at least one lighting device operable to illuminate an area that is one or more of below and between the at least one cushion 30. In various embodiments, the face-piece 20 comprises a sachet operable to provide aromatherapy.

In certain embodiments, one or more of the face-piece 20, the shoulder pieces 40, and the pelvic-piece 50 comprises an instructional indicator for providing instructions for using the face-down therapeutic system 10. In a representative embodiment, one or more of the face-piece 20, the shoulder pieces 40, and the pelvic-piece 50 comprises a vibrating mechanism operable to vibrate the one or more of the face-piece 20, the shoulder pieces 40, and the pelvic-piece 50. In various embodiments, one or more of the face-piece 20, the shoulder pieces 40, and the pelvic-piece 50 comprises a temperature control element operable to adjust the temperature of the one or more of the face-piece 20, the shoulder pieces 40, and the pelvic-piece 50. In certain embodiments, the system 10 comprises one or more of a roll and a semi-circular pad operable to receive ankles of the user. In a representative embodiment, the system 10 comprises a plurality of extensions pieces operable to detachably couple one or more of the face-piece 20 to each of the shoulder pieces 40, and the pelvic-piece 50 to each of the shoulder pieces 40.

In various embodiments, the flat surface is an index mat 60 comprising a plurality of face-piece alignment indicators 61 for providing a plurality of alignment options for the face-piece 20. The index mat 60 comprises a plurality of shoulder-piece alignment indicators 62 for providing a plurality of alignment options for the shoulder pieces 40. The index mat 60 comprises a plurality of pelvic-piece alignment indicators 63 for providing a plurality of alignment options for the pelvic-piece 50. In certain embodiments, the index mat 60 is operable to receive the face-piece 20 based on the plurality of face-piece alignment indicators 61, the shoulder pieces 40 based on the plurality of shoulder-piece alignment indicators 62, and the pelvic-piece 50 based on the plurality of pelvic-piece alignment indicators 63. In a representative embodiment, the face-piece 20, the shoulder pieces 40, the pelvic-piece 50, and the index mat 60 comprise a plurality of attachment mechanisms such that the face-piece 20, the shoulder pieces 40, and the pelvic-piece 50 are detachably coupleable to the index mat 60. In various embodiments, the index mat 60 comprises at least one handle for carrying the index mat 60.

Aspects of the present invention may be seen in a method 800 for arranging a face-down therapeutic system 10. In a representative embodiment, the method 800 comprises positioning 820 a face-piece 20 of a face-down therapeutic system 10 on a flat surface. The method 800 comprises positioning 830 shoulder pieces 40 of the face-down therapeutic system 10 on the flat surface. The method 800 comprises positioning 840 a pelvic-piece 50 of the face-down therapeutic system 10 on the flat surface. The method 800 comprises laying 860 face-down on the face-down therapeutic system 10 such that a face of a user is positioned in the face-piece 20, shoulders of the user are positioned on the shoulder pieces 40, and a pelvis of the user is positioned on the pelvic-piece 50.

In various embodiments, one or more of the face-piece 20 is positioned with respect to at least one of the shoulder pieces 40 and the pelvic-piece 50, the shoulder pieces 40 are positioned with respect to at least one each other 40, the face-piece 20, and the pelvic-piece 50, and the pelvic-piece 50 is positioned with respect to at least one of the shoulder pieces 40 and the face-piece 20. In certain embodiments, the flat surface is an index mat 60 comprising a plurality of face-piece alignment indicators 61 for providing a plurality of alignment options for the face-piece 20. The index mat 60 comprises a plurality of shoulder-piece alignment indicators 62 for providing a plurality of alignment options for the shoulder pieces 40. The index mat 60 comprises a plurality of pelvic-piece alignment indicators 63 for providing a plurality of alignment options for the pelvic-piece 50.

In a representative embodiment, the method 800 comprises laying out 810 the index mat 60 prior to positioning 820-840 the face-piece 20, the shoulder pieces 40, and the pelvic-piece 50. In various embodiments, the positioning 820-840 the face-piece 20, the shoulder pieces 40, and the pelvic-piece 50 comprises positioning 820 the face-piece 20 based on the plurality of face-piece alignment indicators 61, positioning 830 the shoulder pieces 40 based on the plurality of shoulder-piece alignment indicators 62, and positioning 840 the pelvic-piece 50 based on the plurality of pelvic-piece alignment indicators 63. In certain embodiments, the positioning 820-840 the face-piece 20, the shoulder pieces 40, and the pelvic-piece 50 comprises detachably coupling 820 the face-piece 20 to the index mat 60, detachably coupling 830 the shoulder pieces 40 to the index mat 60, and detachably coupling 840 the pelvic-piece 50 to the index mat 60. In a representative embodiment, the method 800 comprises positioning 850 an ankle support on the flat surface such that ankles of the user are positioned on the ankle support when lying face down on the face-down therapeutic system 10.

Although devices, methods, and systems according to the present invention may have been described in connection with a preferred embodiment, it is not intended to be limited to the specific form set forth herein, but on the contrary, it is intended to cover such alternative, modifications, and equivalents, as can be reasonably included within the scope of the invention as defined by this disclosure and appended diagrams.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A face-down therapeutic system comprising:

a face-piece comprising a generally U-shaped cushion having a top side and a bottom side, the top side of the U-shaped cushion configured to receive a face of a user, the face-piece comprising at least one cut-out under the bottom side of the U-shaped cushion to provide access to air, the face-piece configured to be positioned on a continuous flat surface;

two padded shoulder pieces, each of the shoulder pieces configured to receive a shoulder of the user, the shoulder pieces configured to be positioned on the continuous flat surface; and a padded pelvic-piece configured to receive a pelvis of the user, the pelvic-piece configured to be positioned on the continuous flat surface;

wherein the continuous flat surface is an index mat comprising:

one or more face-piece alignment indicators for providing one or more alignment options for the face-piece, a plurality of shoulder-piece alignment indicators for providing a plurality of alignment options for the shoulder pieces, and a plurality of pelvic-piece alignment indicators for providing a plurality of alignment options for the pelvic-piece.

2. The system according to claim 1, wherein each of the two padded shoulder pieces is a generally rectangular box-shaped piece.

3. The system according to claim 2, wherein each of the two padded shoulder pieces comprises a top cushioned layer configured to receive the shoulder of the user and a body layer that is firmer than the top cushioned layer.

4. The system according to claim 3, wherein each of the two padded shoulder pieces comprises a base layer comprising multiple sub-layers that are added or removed to adjust a height of each of the two padded shoulder pieces.

5. The system according to claim 1, wherein the pelvic-piece is generally a rectangular or trapezoidal box-shaped piece.

6. The system according to claim 5, wherein the pelvic-piece comprises a top cushioned layer configured to receive the pelvis of the user and a body layer that is firmer than the top cushioned layer.

7. The system according to claim 6, wherein the pelvic-piece comprises a base layer comprising multiple sub-layers that are added or removed to adjust a height of the pelvic-piece.

8. The system according to claim 1, wherein the height of the shoulder pieces and the pelvic-piece is adjustable.

9. The system according to claim 1, wherein the U-shaped cushion is configured to receive a forehead and one or both of cheeks and points on a jaw of the face of the user.

10. The system according to claim 1, wherein the U-shaped cushion is configured to contact pressure points on the face of the user to align a jaw of the user.

11. The system according to claim 1, wherein at least one of the U-shaped cushion, the shoulder pieces, and the pelvic-piece comprises a removeable cover.

12. The system according to claim 1, wherein at least one of the U-shaped cushion, the shoulder pieces, and the pelvic-piece is at least one of:

foam, a vinyl inflatable vessel, and a water or oil filled bladder.

13. The system according to claim 1, wherein the face-piece comprises:

at least one speaker, and an audio port connected to the at least one speaker, the audio port configured to receive an audio input and provide the audio input to the at least one speaker.

14. The system according to claim 1, wherein the face-piece comprises at least one lighting device configured to illuminate an area that is at least one of below and between the U-shaped cushion.

15. The system according to claim 1, wherein the face-piece comprises a sachet configured to provide aroma-therapy.

16. The system according to claim 1, wherein at least one of the face-piece, the shoulder pieces, and the pelvic-piece comprises an instructional indicator for providing instructions for using the face-down therapeutic system.

17. The system according to claim 1, wherein at least one of the face-piece, the shoulder pieces, and the pelvic-piece comprises a vibrating mechanism configured to vibrate the at least one of the face-piece, the shoulder pieces, and the pelvic-piece.

18. The system according to claim 1, wherein at least one of the face-piece, the shoulder pieces, and the pelvic-piece comprises a temperature control element configured to adjust the temperature of the at least one of the face-piece, the shoulder pieces, and the pelvic-piece.

19. The system according to claim 1, comprising at least one of a roll and a semi-circular pad configured to receive ankles of the user.

20. The system according to claim 1, comprising a plurality of extension pieces configured to detachably couple at least one:

the face-piece to each of the shoulder pieces, and the pelvic-piece to each of the shoulder pieces.

21. The system according to claim 1, wherein the index mat is configured receive:

the face-piece based on the one or more face-piece alignment indicators, the shoulder pieces based on the plurality of shoulder-piece alignment indicators, and the pelvic-piece based on the plurality of pelvic-piece alignment indicators.

22. The system according to claim 1, wherein the face-piece, the shoulder pieces, the pelvic-piece, and the index mat comprise a plurality of attachment mechanisms such that the face-piece, the shoulder pieces, and the pelvic-piece are detachably coupleable to the index mat.

23. The system according to claim 1, wherein the index mat comprises at least one handle for carrying the index mat.

24. A method for arranging a face-down therapeutic system, the method comprising:

positioning a face-piece of a face-down therapeutic system on a continuous flat surface, the face-piece comprising a generally U-shaped cushion having a top side and a bottom side, the top side of the U-shaped cushion configured to receive a face of a user, the face-piece comprising at least one cut-out under the bottom side of the U-shaped cushion to provide access to air;

positioning two padded shoulder pieces of the face-down therapeutic system on the continuous flat surface, each of the shoulder pieces configured to receive a shoulder of the user;

positioning a padded pelvic-piece of the face-down therapeutic system on the continuous flat surface, the padded pelvic-piece configured to receive a pelvis of the user; and laying face-down on the face-down therapeutic system such that a face of a user is positioned in the U-shaped cushion of the face-piece, shoulders of the user are positioned on the shoulder pieces, and a pelvis of the user is positioned on the pelvic-piece;

wherein the continuous flat surface is an index mat comprising:

one or more face-piece alignment indicators for providing one or more alignment options for the face-piece, a plurality of shoulder-piece alignment indicators for providing a plurality of alignment options for the shoulder pieces, and a plurality of pelvic-piece alignment indicators for providing a plurality of alignment options for the pelvic-piece.

25. The method according to claim 24, wherein at least one of:

the face-piece is positioned with respect to at least one of the shoulder pieces and the pelvic-piece, the shoulder pieces are positioned with respect to at least one each other, the face-piece, and the pelvic-piece, and the pelvic-piece is positioned with respect to at least one of the shoulder pieces and the face-piece.

26. The method according to claim 24, comprising laying out the index mat prior to positioning the face-piece, the shoulder pieces, and the pelvic-piece.

27. The method according to claim 24, wherein the positioning the face-piece, the shoulder pieces, and the pelvic-piece comprises:

positioning the face-piece based on the one or more face-piece alignment indicators, positioning the shoulder pieces based on the plurality of shoulder-piece alignment indicators, and positioning the pelvic-piece based on the plurality of pelvic-piece alignment indicators.

28. The method according to claim 24, wherein the positioning the face-piece, the shoulder pieces, and the pelvic-piece comprises:

detachably coupling the face-piece to the index mat, detachably coupling the shoulder pieces to the index mat, and detachably coupling the pelvic-piece to the index mat.

29. The method according to claim 24, comprising positioning an ankle support on the flat surface, wherein ankles of the user are positioned on the ankle support when lying face down on the face-down therapeutic system.

* * * * *